US010793234B2

(12) United States Patent
Milne et al.

(10) Patent No.: US 10,793,234 B2
(45) Date of Patent: Oct. 6, 2020

(54) FIN FIXING SYSTEM

(71) Applicants: John DeCourcey Milne, Brisbane (AU); Tyler Stokes Callaway, Del Mar, CA (US)

(72) Inventors: John DeCourcey Milne, Brisbane (AU); Tyler Stokes Callaway, Del Mar, CA (US)

( * ) Notice: Subject to any disclaimer, the term of this patent is extended or adjusted under 35 U.S.C. 154(b) by 0 days.

(21) Appl. No.: 16/438,222

(22) Filed: Jun. 11, 2019

(65) Prior Publication Data

US 2019/0382086 A1 Dec. 19, 2019

Related U.S. Application Data

(60) Provisional application No. 62/684,327, filed on Jun. 13, 2018.

(51) Int. Cl.
*B63B 32/66* (2020.01)

(52) U.S. Cl.
CPC ..... *B63B 32/66* (2020.02)

(58) Field of Classification Search
CPC ... B63B 35/79; B63B 35/793; B63B 35/7906; B63B 35/7926; B63B 32/20; B63B 32/60; B63B 32/66
USPC ..... 441/79
See application file for complete search history.

(56) References Cited

U.S. PATENT DOCUMENTS 9,751,600 B2 * 9/2017 Elliott ..... B63B 32/66
2015/0239532 A1 * 8/2015 Wood ..... B63B 32/66 441/79

* cited by examiner

*Primary Examiner* — Lars A Olson
(74) *Attorney, Agent, or Firm* — Eric Hanscom

(57) ABSTRACT

This invention is directed toward a fin box capable of accepting either a Futures or an FCS fin without the need for any additional products being added to either the fins or the fin box. The box has an internally-adjustable wedge that can force the bottom of a fin into an indent, thereby giving it a cant or angle. The box also has channels for both FCS and Futures fins, such that a user can easily exchange either brand of fin without adding or subtracting items from the fins or fin boxes.

19 Claims, 13 Drawing Sheets

FIN FIXING SYSTEM

CROSS REFERENCE TO RELATED APPLICATIONS

This application claims priority back to U.S. Provisional No. 62/684,327 filed 13 Jun. 2018, entitled Fin Fixing System, the contents of which are incorporated by reference into this application.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of surfing and surfboard fins, and more specifically to a fin fixing system that will allow a single surfboard to use multiple brands of surfboard fins.

Brief Description of Invention

The invention has particular application to a surfboard fin fixing system, and for illustrative purposes, reference will be made to such application. However, this invention may also apply to the fixing or attachment of fins to other aquafoils such as surf skis or the like.

History of the Invention

From about 1948 onwards, fins have become an almost universally affixed feature of surfboards, but in more recent times, removable fins have dominated over fins which are permanently fixed in place. There have been several attempts to provide systems for fixing fins to surfboards, but many suffer from drawbacks, including complexity, lack of mechanical strength, requirement for tools, and lack of interoperability between different systems.

Prevalent amongst the fin fixing systems is the use of a fin box which is permanently fixed into the surfboard and which provides a slot into which tabs, flanges or similar types of protrusion extend. Mechanical arrangements for the fixing of the fin in the fin box have varied considerably, mostly in similar fashion to those marketed by Fin Control Systems Pty Ltd (FCS), a system which evolved from the provision of slotted plugs in which the slot received one of two or more tabs of a fin. Because of the popularity of FCS fins, it would be advantageous if new fin fixing systems were mechanically compatible with FCS fins. While this application uses the brand names "FCS" and "Futures", it is intended to cover any use of any fin that is constructed to fit into any type of fin box traditionally associated with either the FCS or Futures line of fins.

Surfboards are generally ridden in a particular direction and for reference purposes, the following terminology is used in this specification for convenience of reference, particularly with regard to the direction and relative positions of elements of the invention, unless the context indicates otherwise. "Longitudinal" refers to the dimension extending from the bow to the stern, or the front to the rear, of the surfboard. "Abeam" refers to the dimension extending across the surfboard substantially at right angles to the longitudinal axis and in substantial alignment with the deck or upper face of the surfboard. "Transverse" refers to the dimension substantially at right angles to the other two dimensions. The terms "above" and "below" refer to the surfboard in its normal orientation with the fins extending downwards below the surfboard unless the context indicates otherwise, and are not to be taken as limiting the surfboard to any particular orientation. When fins and fin systems are illustrated separately from the surfboard, the orientation is often upside down—that is, pointing upwards, and the fins illustrated in accordance with the present invention are also illustrated in such orientation.

The present invention aims to provide a surfboard fin fixing system which alleviates one or more of the above drawbacks and provide a surfboard with fins attached in a way which will be reliable and efficient in use. Other aims and advantages of the present invention may become apparent from the following description.

A typical fin box is an elongate fin box fixable in a surfboard aligned substantially along or at an acute angle beside the longitudinal axis of the surfboard, the fin box having a slot extending longitudinally and having a forward end, a rearward end, a base wall and two opposed substantially parallel side walls and an outer face intended to be substantially aligned with the lower face of a surfboard, the opening of the slot being at the outer face. Unless the context indicates otherwise, fin boxes substantially of this form will be referred to herein as fin boxes as herein described.

With the foregoing objects in view, this invention in one aspect resides broadly in a fin fixing system including:

a fin having one or more fin tabs for insertion into the slot of a fin box as herein described, the one or more tabs having a distal end face, and being tapered at a selected angle towards the distal end face;

an elongate wedge sized for insertion into the slot substantially along the length thereof and having a slot engaging face and a tab engaging face at an angle to the slot engaging face, hereinafter referred to as the wedge angle, the wedge angle being substantially commensurate with the selected angle of the taper of the tabs of the fin such that relative movement between the wedge and the tabs results in expansion of the dimension abeam thereof for tight engagement of the tabs and the wedge in the slot of the fin box.

An adaptor may also be provided, being sized to fit into an alternative fin box and having a slot of substantially the same form as that of the fin box hereinbefore described, the alternative fin box having a channel or aperture sized to receive the adaptor.

In another aspect, this invention resides broadly in a fin fixing system including:

a fin box as herein described, the fin box further including latch means at the rear end of the slot;

an adaptor sized to fit into the slot, the adaptor having a font end and a rear end, a protrusion extending from the front end and formed to fit into the forward indentation of the slot, and complementary latch means co-operable with the latch means of the slot for retaining the adaptor in the slot.

In such form, the adaptor is arranged to receive the wedge and tapered tabs as hereinbefore described. The latch means preferably includes portions or separate parts having a resilient bias substantially lateral to the fin box, the lateral dimension being somewhat abeam to the surfboard and being set forth.

OBJECTS OF THE INVENTION

It is therefore an object of the present invention to provide. A fin box assembly for a fin fixing system, requiring no additional pieces, accessories or inserts, such that a Futures fin type channel can be configured to accommodate and secure an FCS type fin to the required cant angle.

Additional objects of the invention include. A fin box assembly for a fin fixing system, comprising: a Futures type fin channel, an FCS type fin channel created by the encroachment of a wedge into the Futures type channel moved by wedge adjustment screws where an FCS type fin can be inserted into the FCS type channel, and a Futures type fin can be inserted into the Futures type fin channel when the wedge is retracted.

Further objects of the invention include, variations in the activation and adjustment of the wedge used to alter the channel to accommodate either Futures fins or FCS fins.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

In order that this invention may be more readily understood and put into practical effect, reference will now be made to the following drawings which illustrate several preferred embodiments of the invention, and wherein:

BRIEF DESCRIPTION OF THE FIGURES

One preferred form of the invention will now be described with reference to the accompanying drawings.

REFERENCE NUMBERS USED

Figure 1:
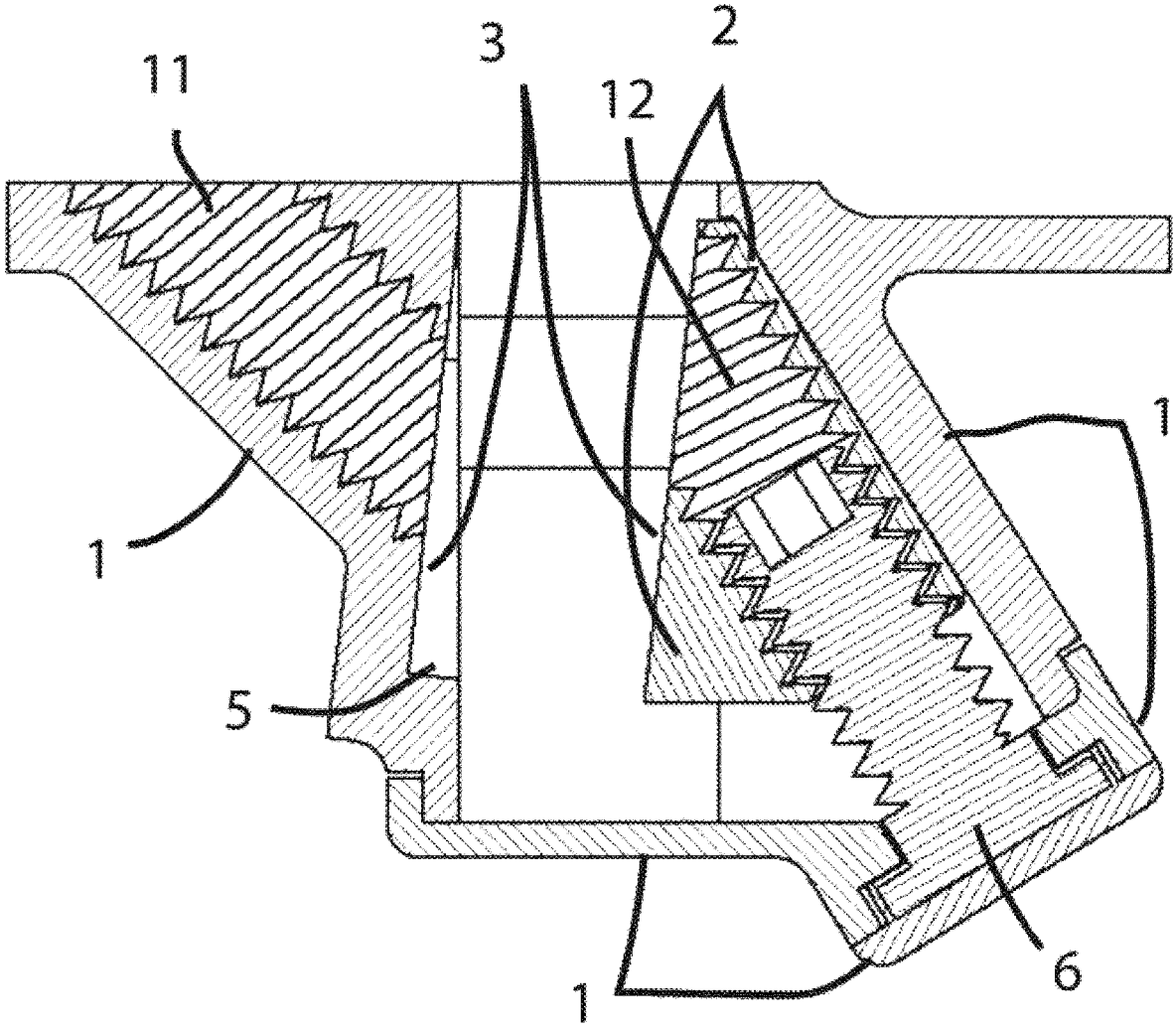
FIG. 1 is a lateral cross section of a fin fixing system according to the invention having a fin box which includes hollow sections.

1. Box
2. Wedge
3. Channel created for FCS
4. Cavity for Futures
5. Indent for FCS to create angle
6. Wedge adjustment screw
7. Grub screw
8. FCS fin
9. FCS fin base
10. Futures fin base
11. Grub screw hole
12. Wedge screw access
13. Futures fin
14. Futures fin angle at base
15. FCS fin no angle at base
16. Angled lock screw hole
17. Sawtooth adjustment screw
18. Longitudinal adjustment plate
19. Sawtooth wedge
20. Sawtooth Adjustment screw hole
21. Sawtooth box body
22. Clip/latch/button
23. Spring material
24. Cavity
25. Cap
26. Engagement point
27. Fin
28. Spring

DETAILED DESCRIPTION OF THE FIGURES

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is a lateral cross section of a fin fixing system according to the invention. The general concept behind this fin box is that through the movement of basically five screws and a wedge, a single fin box can handle fins from both FCS and Futures. There are no inserts needed or anything else to adhere to a fin or insert into the fin box the box; the fin box comes with everything a surfer needs to use either an FCS or a Futures fin. The fin box, 1 shows the parallel channel 3 created by the encroachment of the wedge 2 and the indent 5 for the acceptance of an FCS fin base. The wedge 2 can be adjusted by the wedge adjustment screw 6 which lies in a wedge screw access 12. On the other side of the fin box 1 is a grub screw hole 11 in which a grub screw 7 can be placed, which can be used to exert pressure on the other side of the fin thus retaining the fin in place.

Figure 2:
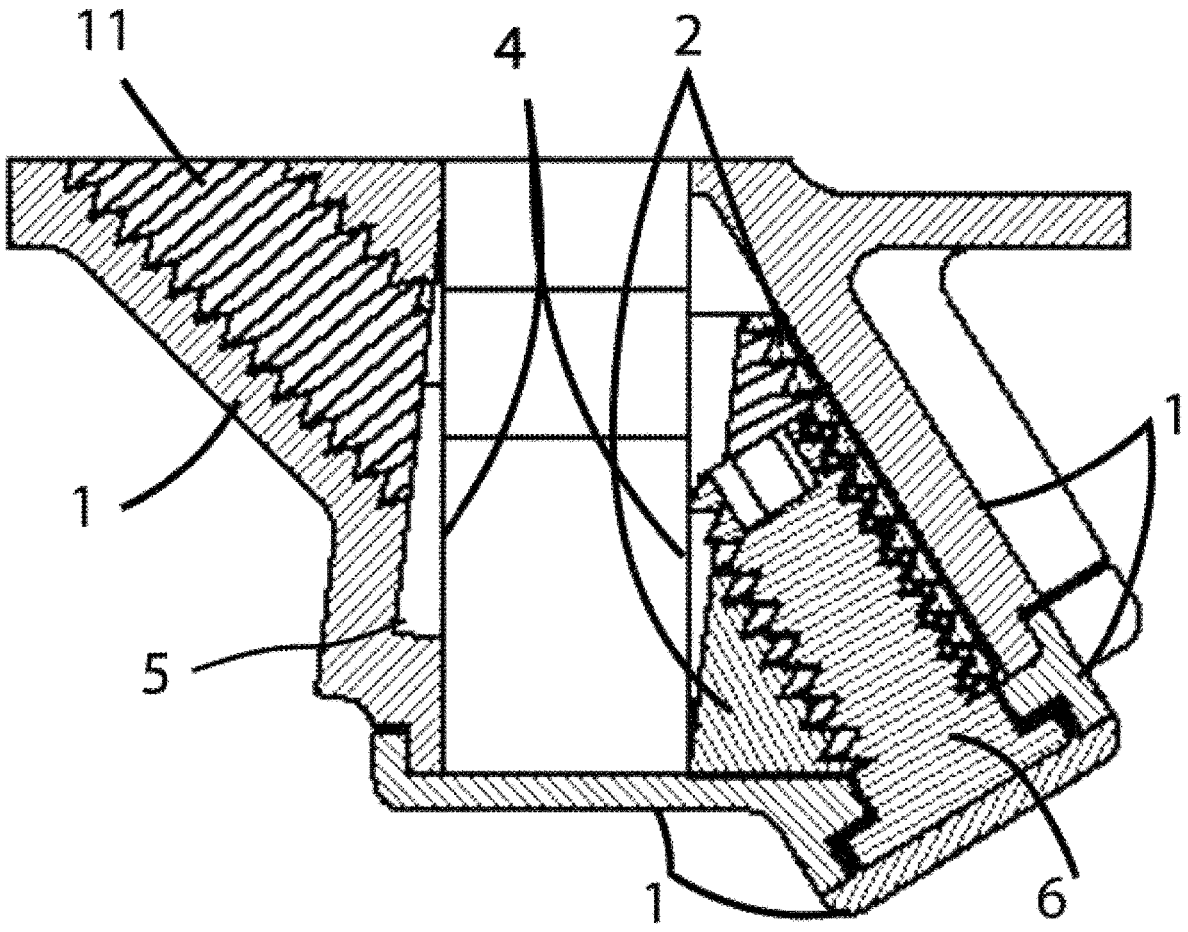
FIG. 2 is a lateral cross section of the fin fixing system of FIG. 1 wherein the fin box does not include the hollow sections.
Figure 6:
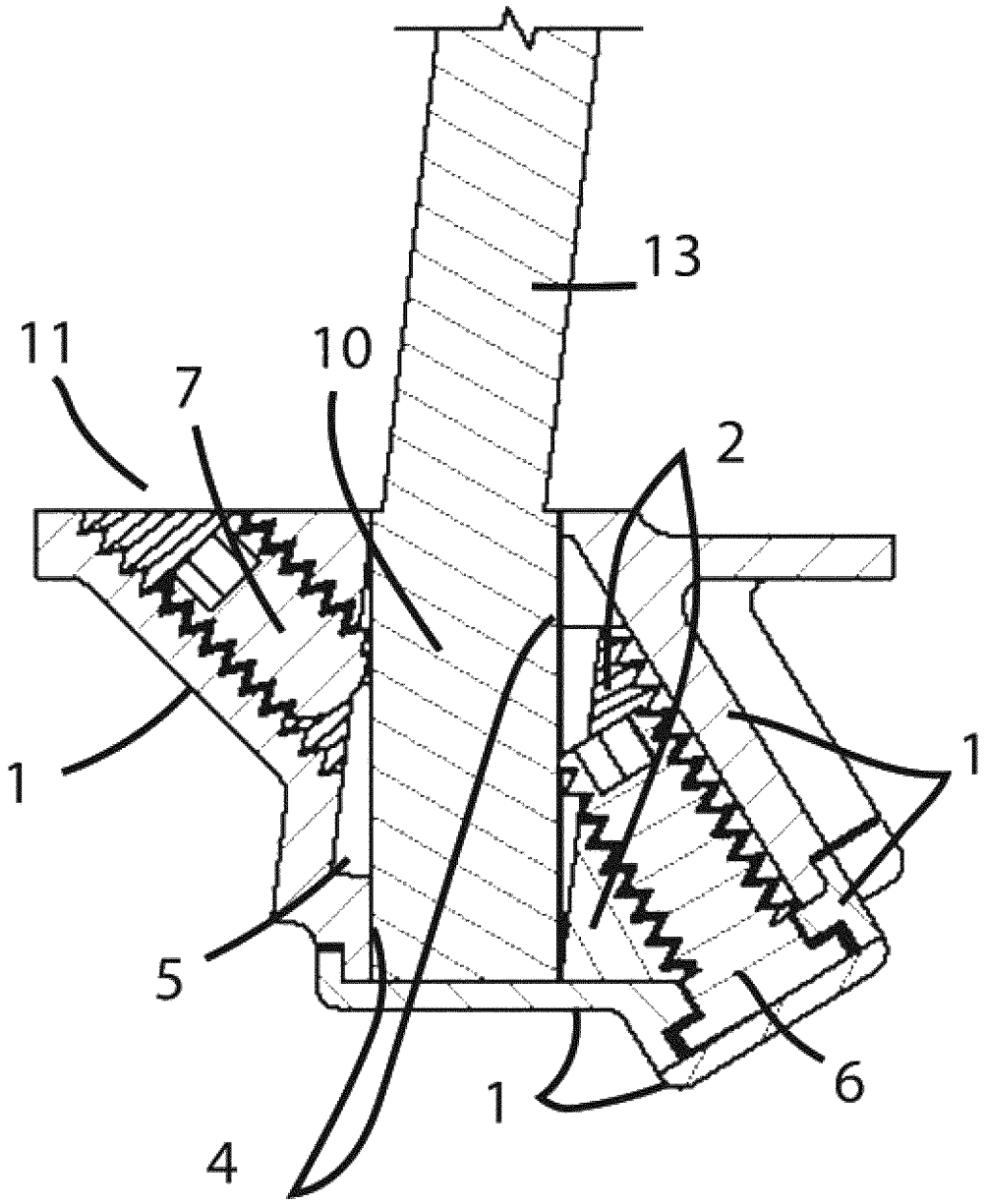
FIG. 6 is a lateral cross section a canted fine in the fin fixing system of FIG. 1 with an alternative adaptor and latch means, showing the fin or adaptor in the slot.

FIG. 2 is a lateral cross section of the fin fixing system according to the invention. In this figure, the wedge 2 has been retracted from an active position through the screwing "down" of the wedge adjustment screw 6 which rests in the wedge screw access 12. Due to the retraction of the wedge 2 the parallel channel 4 now becomes available for the acceptance of a Futures fin base as shown in FIG. 6.

Figure 3:
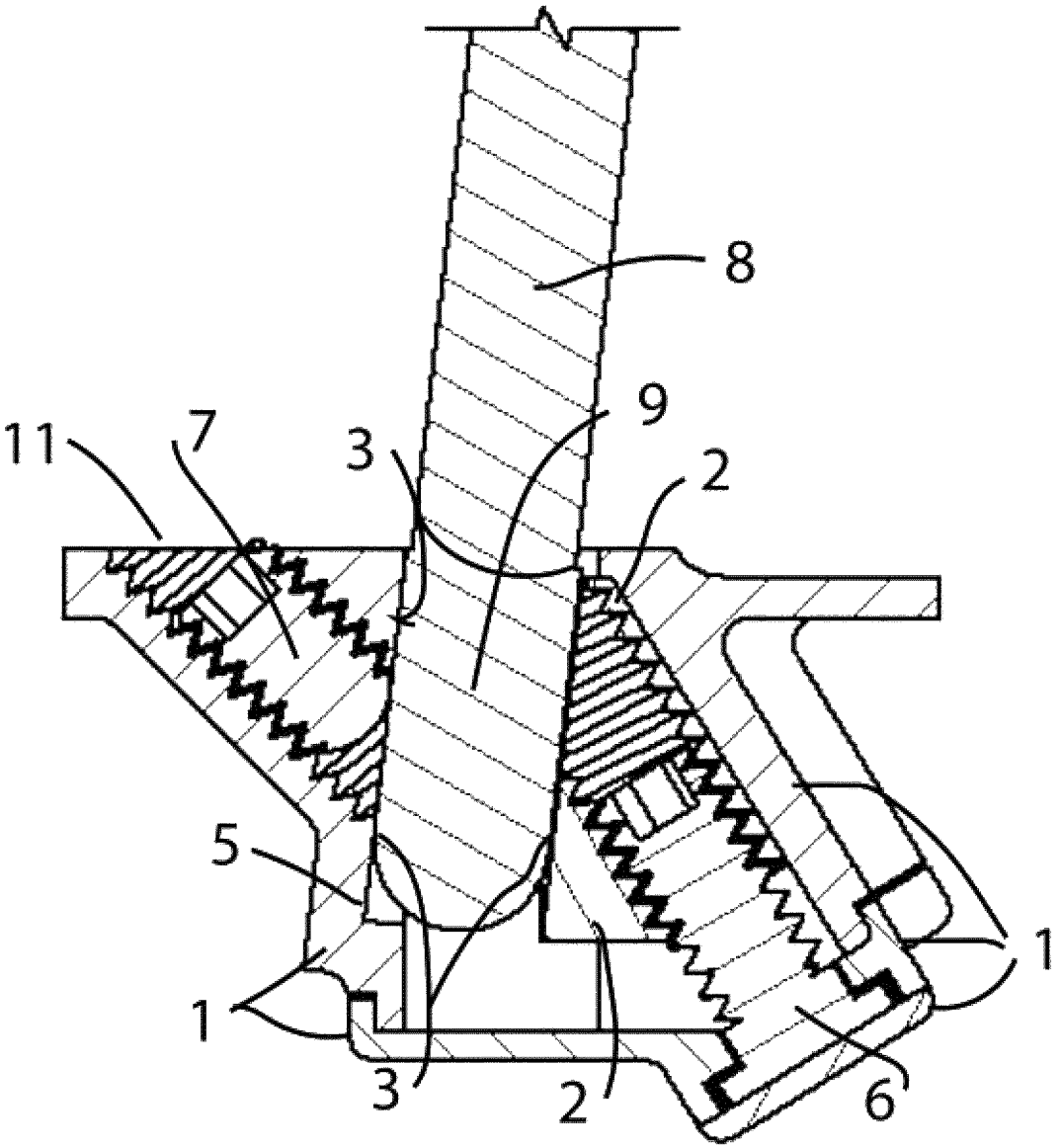
FIG. 3 is a lateral cross section of the fin fixing system of FIG. 1 and incorporating an adaptor and latch means.

FIG. 3 is a lateral cross section of the fin fixing system shown in FIG. 1. With an FCS fin 8 and Base 9 inserted into the fin box 1. The FCS fin base 9 resides in the parallel channel 3 created by the indent 5 and the wedge 2. The grub screw 7 is exerting pressure on the FCS fin base 9 to keep it in the channel 3. Wedge 2 has been activated by the wedge adjustment screw 6 and in cooperation with the indent 5 the channel 3 creates the required cant angle for FCS fin 8. Thereby creating the required cant angle for the FCS fin 8

Figure 4:
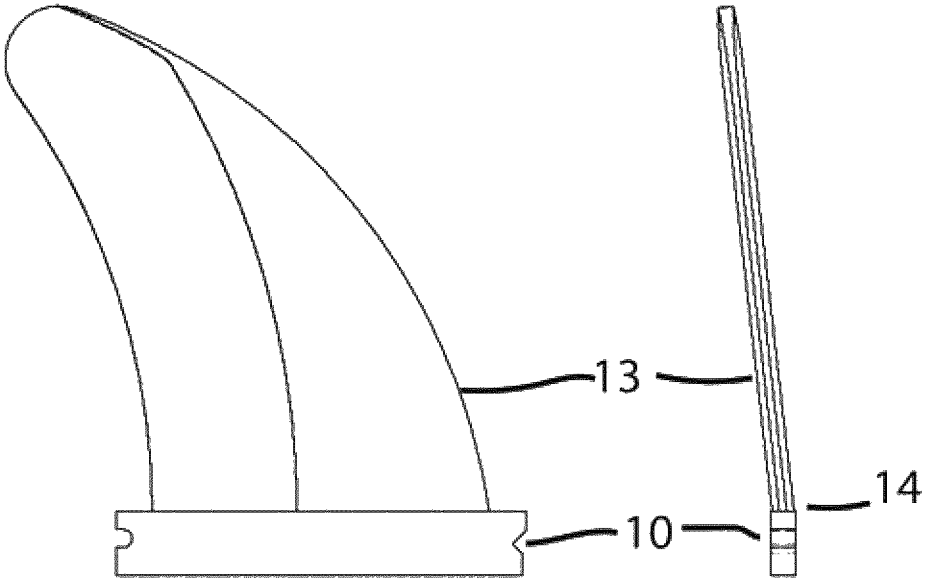
FIG. 4 is a longitudinal cross section of a canted fin in the fin fixing system according to the invention.

FIG. 4 is a side and front view representation of a typical Futures fin 13 indicating the cant angle 14 between the fin 13 and base 10. canted fin in the fin fixing system according to the invention. A Futures fin 13 has been inserted into the Futures fin base 10, which has created a Futures fin angle at base 14.

Figure 5:
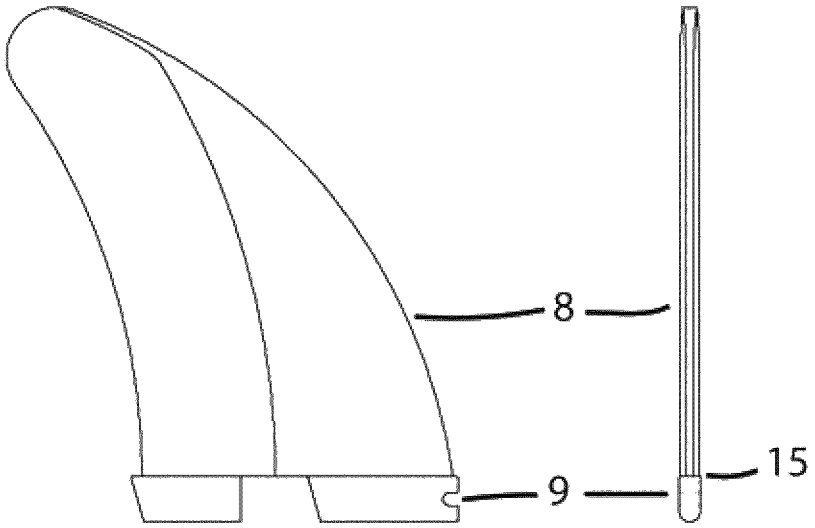
FIG. 5 is a longitudinal cross-sectional view of an upright fin.

FIG. 5 is a side and front view representation of a typical FCS fin 8 with and FCS fin base 9 which indicates an FCS fin with no cant angle at base 15.

FIG. 6 is a lateral cross section of the fin fixing system shown in FIG. 2. With The Futures fin 13 and base 10 inserted into the fin box 1. The Futures fin 13 has a canted angle, such that the Futures fin base 10 is not parallel to the direction of the Futures fin 13. The wedge 2 has been pulled back and down, by wedge adjustment screw 6 such that the channel 4 is available for the acceptance of the Futures base 10. Force from the grub screw 7 holds the fin 13 in place.

Figure 7:
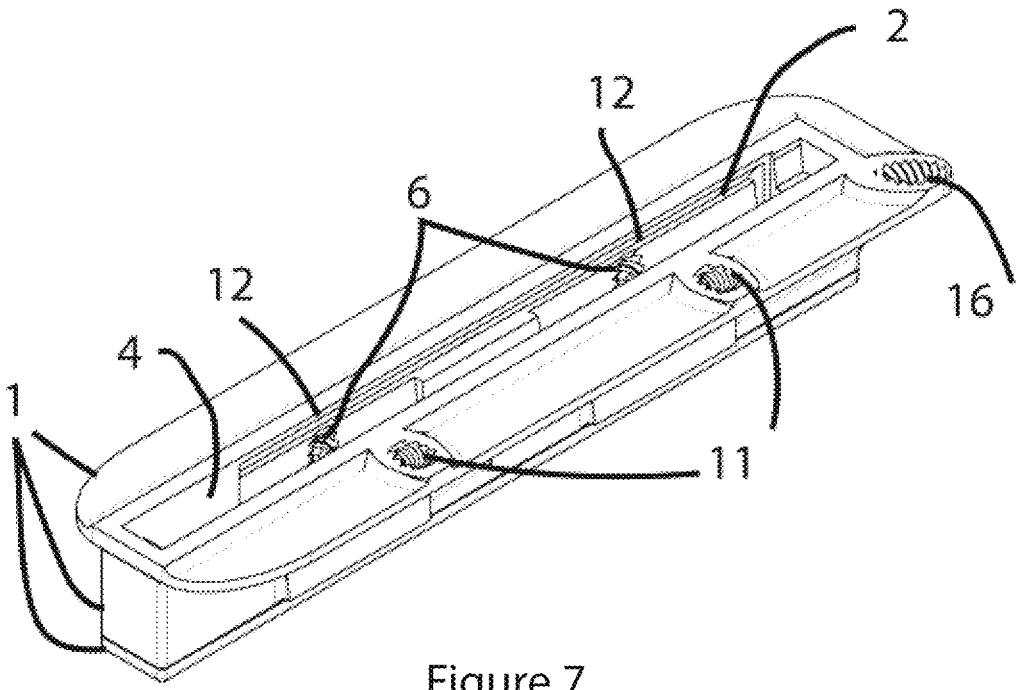
FIG. 7 is a top, perspective view of the fin fixing system of FIG. 6 showing the fin or adaptor not in the slot.

FIG. 7 is a top, perspective view of the fin fixing system of FIG. 6 showing the fin or adaptor not in the slot. On one side of the fin box 1 is the wedge 2 and wedge adjustment screws 6. On the other side are two grub screw holes 11 and an angled lock screw hole 16 which functions to provide access for a further grub screw to lock in the leading edge of the fin.

Figure 8:
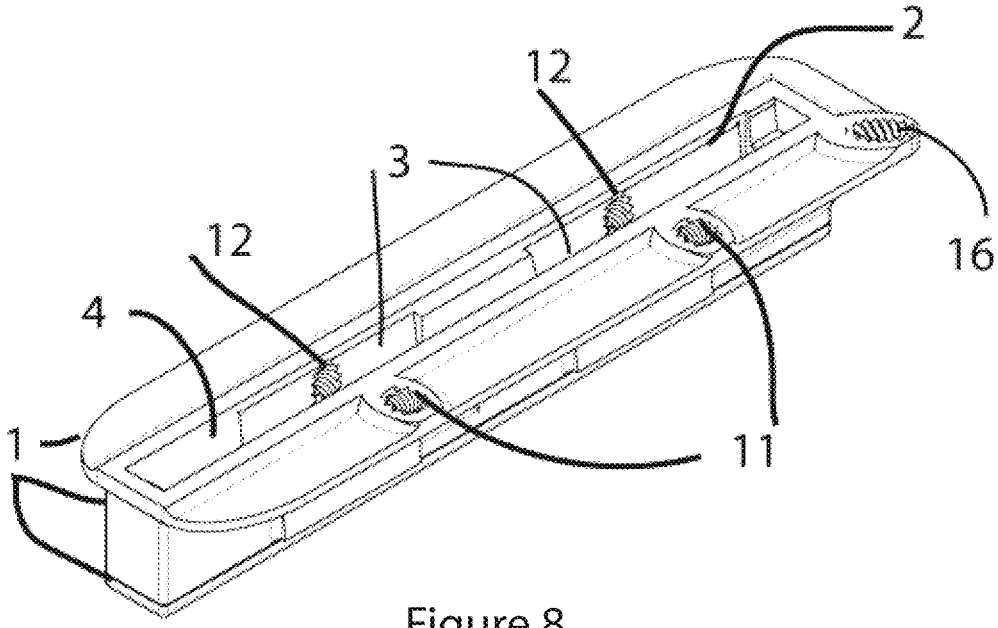
FIG. 8 is a top, perspective view of the fin fixing system of FIG. 7 showing the fin or adaptor not in the slot.

FIG. 8 is a top, perspective view of the fin fixing system of FIG. 7 showing the fin or adaptor not in the slot. This figure is identical to FIG. 7, except that the wedge 2 has been extended in this figure.

Figure 9:
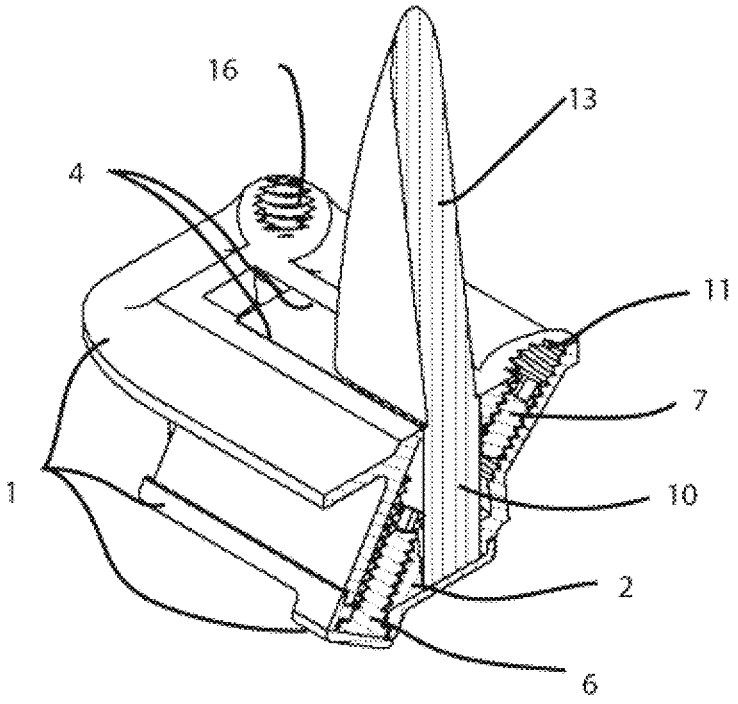
FIG. 9 is a side, perspective view of an FCS fin being restrained in a fin box.

FIG. 9 is an angled perspective view of FIG. 6 of a Futures fin 13 being restrained in the fin box 1. The Futures fin 13 has a canted angle, such that the Futures fin base 10 is not parallel to the direction of the Futures fin 13. The wedge 2 has been pulled back and down, by force from the grub screw 7 holds the fin in place.

Figure 10:
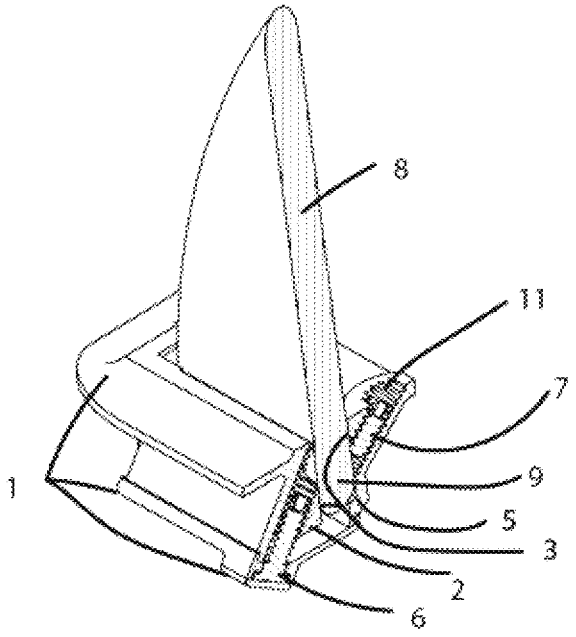
FIG. 10 is a side, perspective view of a Futures fin being restrained in a fin box.

FIG. 10 is a an angled perspective view of FIG. 3 of an FCS fin 8 and base 9 being restrained in a fin box 1. The FCS fin base 9 resides in the parallel channel 3 created by the indent 5 and the wedge 2. The grub screw 7 is exerting pressure on the FCS fin base 9 to keep it in the channel 3. Wedge 2 has been activated by the wedge adjustment screw 6 and in cooperation with the indent 5 the channel 3 creates the required cant angle for FCS fin 8. Thereby creating the required cant angle for the FCS fin 8.

Figure 11:
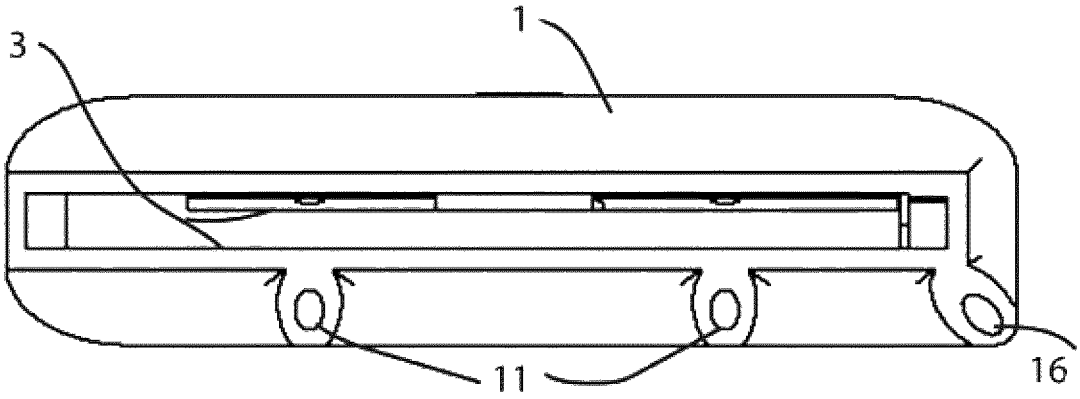
FIG. 11 is top view of the channel created for an FCS fin without the fin in the box.

FIG. 11 is top view of the channel created for an FCS fin without the fin in the box. The wedge 2 is shown as encroached into the channel by the wedge adjustment screws (not shown) creating the required specifications in channel 3 for the insertion of an FCS fin.

Figure 12:
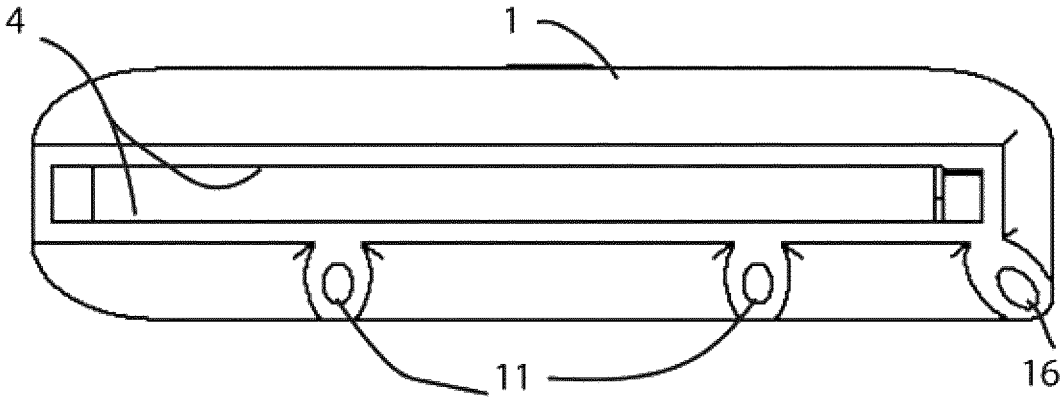
FIG. 12 is a top view of the channel created for a Futures fin without the fin in the box.

FIG. 12 is a top view of the channel 4 for a Futures fin without the fin in the box. It shows the channel 4 available for insertion of a Futures fin without the fin in the box. The channel 4 is shown without the wedge 2 of FIG. 11.

Figure 13:
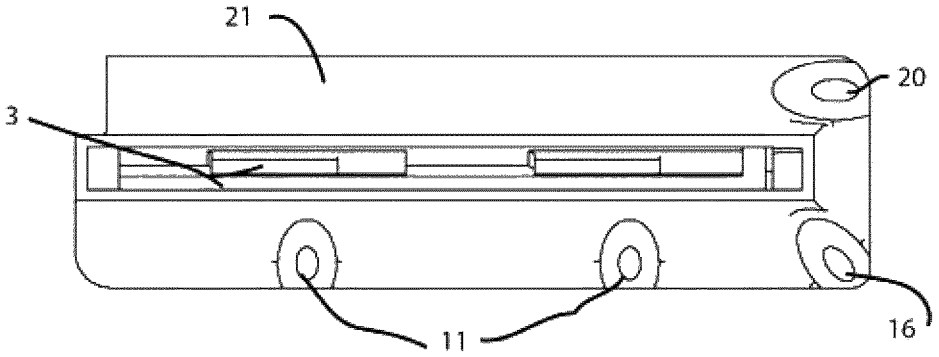
FIGS. 13 through 14 are top views of an alternate embodiment of the fin box.
Figure 14:
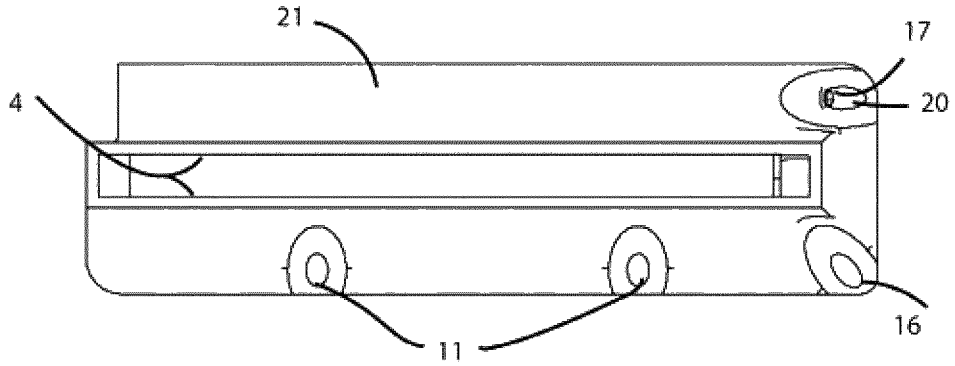

FIGS. 13 through 14 are top views of an alternate embodiment of the fin box.

Figure 15:
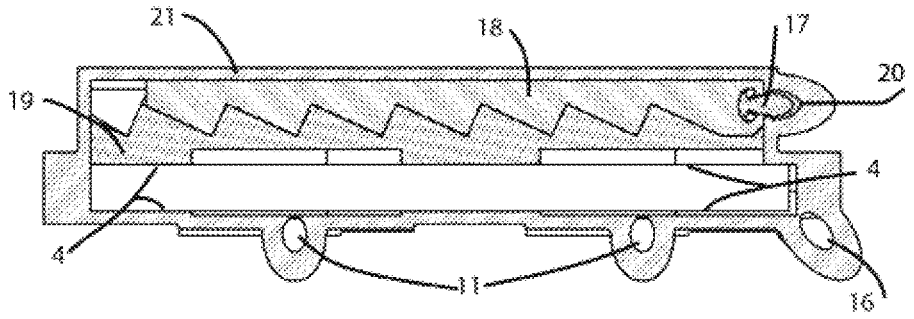
FIG. 15 is a top view of yet another embodiment of the fin box.

FIG. 15 is a top view of yet another embodiment of the fin box.

Figure 16:
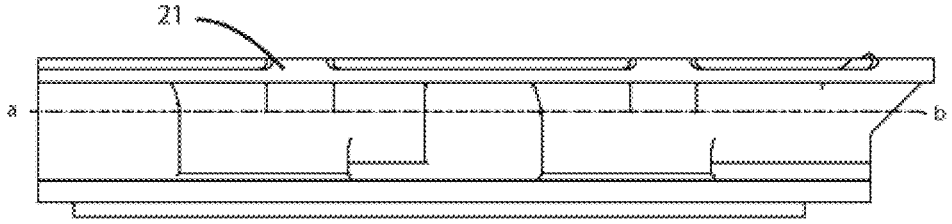
FIG. 16 is a side view of yet another embodiment of the fin box.

FIG. 16 is a side view of yet another embodiment of the fin box.

Figure 17:
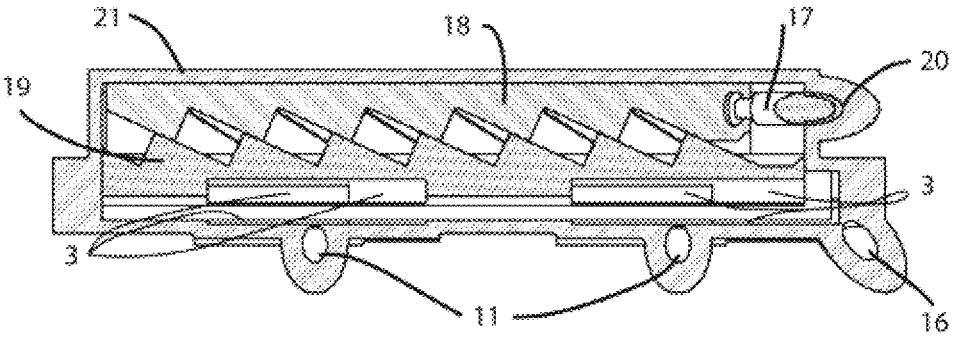
FIG. 17 is a top view yet another embodiment of the fin box.

FIG. 17 is a top view yet another embodiment of the fin box.

Figure 18:
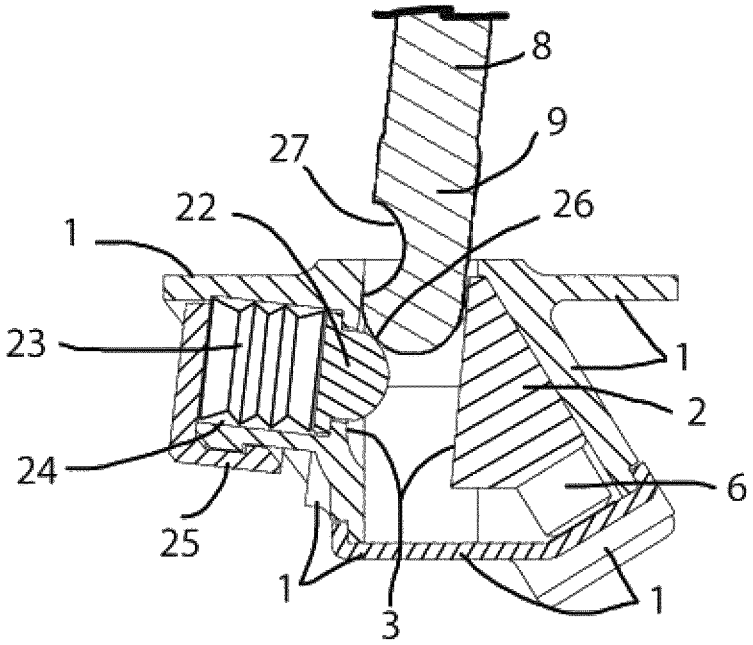
FIG. 18 is a cross-sectional view of one embodiment of the invention.

FIG. 18 is a cross-sectional view of one embodiment of the invention. Drawing 18 indicates the FCS type fin 8 and base 9 being inserted into the box 1 the fin engages the clip/latch/button 22 at the engagement point 26 that starts pushing the clip/latch/button 22 into the cavity 24 compressing the resilient/compressible material 'spring' 23 (shown un-compressed). The cap 25 provides an assembly access to the cavity 24. The channel 3 is provided by the wedge 2 being in the up position after being adjusted by the adjustment screw 6.

Figure 19:
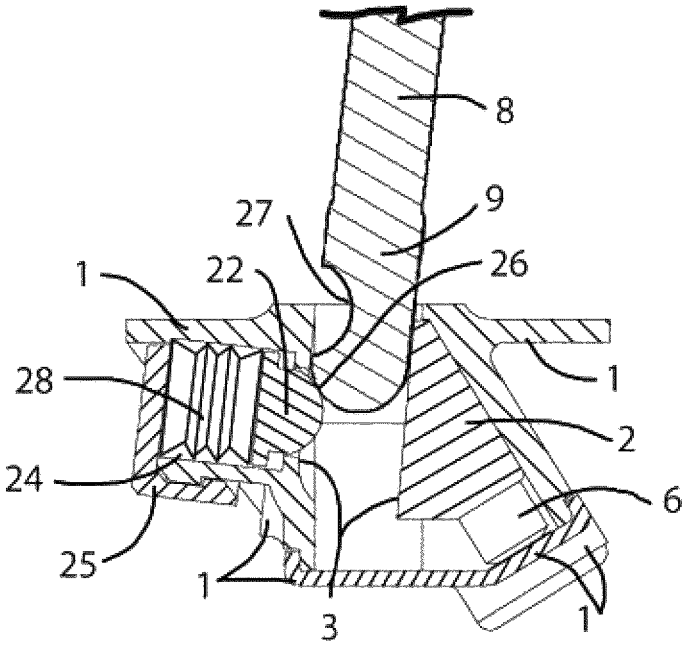
FIG. 19 is a cross-sectional view of one embodiment of the invention.

FIG. 19 is a cross-sectional view of one embodiment of the invention. Drawing 19 shows the fin 8 and base 9 encroaching further into the channel 3 and moving the clip/latch/button 22 further into the cavity 24 and compressing the 'spring' 28 (shown being compressed therefore different number).

Figure 20:
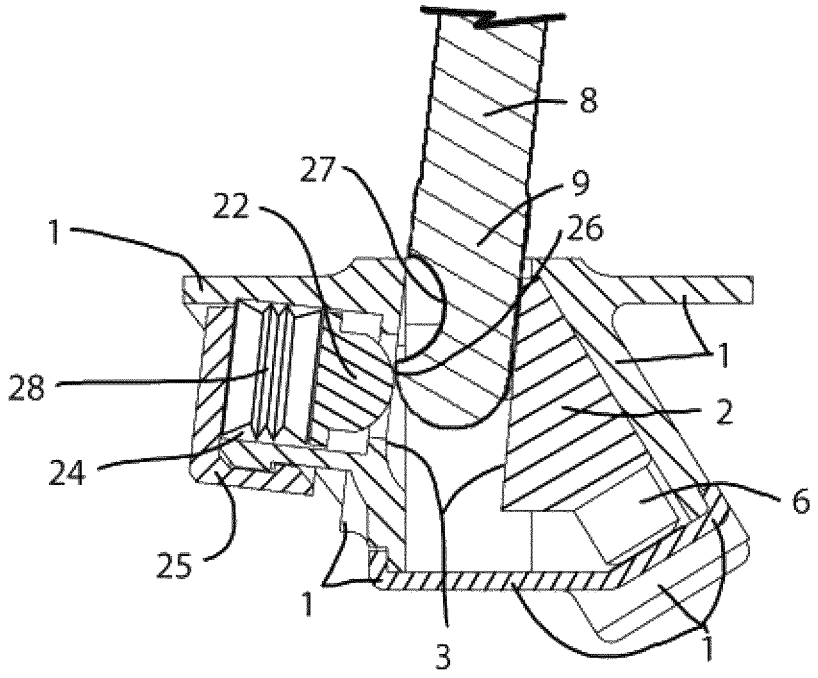
FIG. 20 is a cross-sectional view of one embodiment of the invention.

FIG. 20 is a cross-sectional view of one embodiment of the invention. Drawing 20 shows the fin 8 and base 9 encroaching to the point whereby the engagement point 26 is compressing the 'spring' 28 to maximum compressed state.

Figure 21:
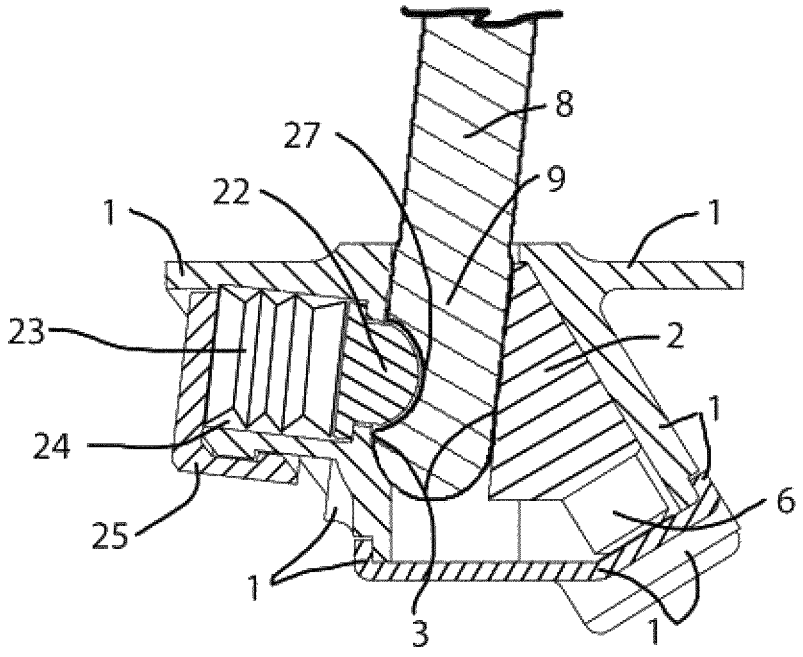
FIG. 21 is a cross-sectional view of one embodiment of the invention.

FIG. 21 is a cross-sectional view of one embodiment of the invention. Drawing 21 show the fin 8 and base 9 having being fully inserted into the channel 3 and the 'spring' 23 now fully un-compressed pushing the clip/latch/button 22 into the channel and occupy the space in the fin 27 thus locking the fin into place.

Figure 22:
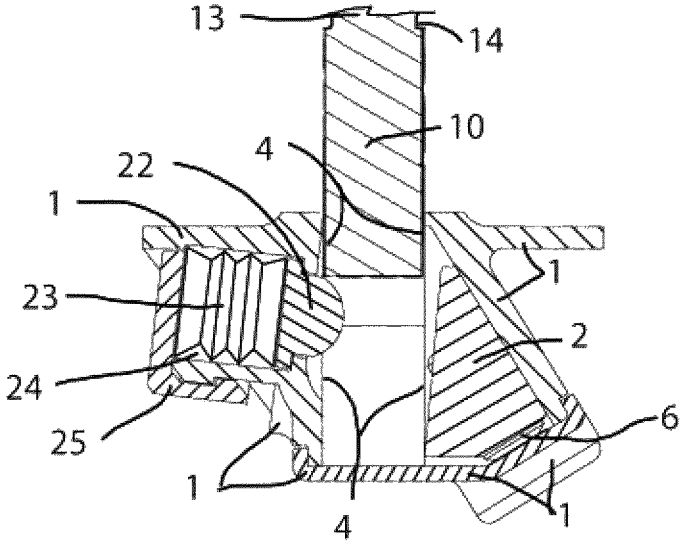
FIG. 22 is a cross-sectional view of one embodiment of the invention.

FIG. 22 is a cross-sectional view of one embodiment of the invention. Drawing 22 indicates Futures type fin 13 and base 10 being inserted into the channel 4 created by the withdrawal of wedge 2 by adjustment screw 6

Figure 23:
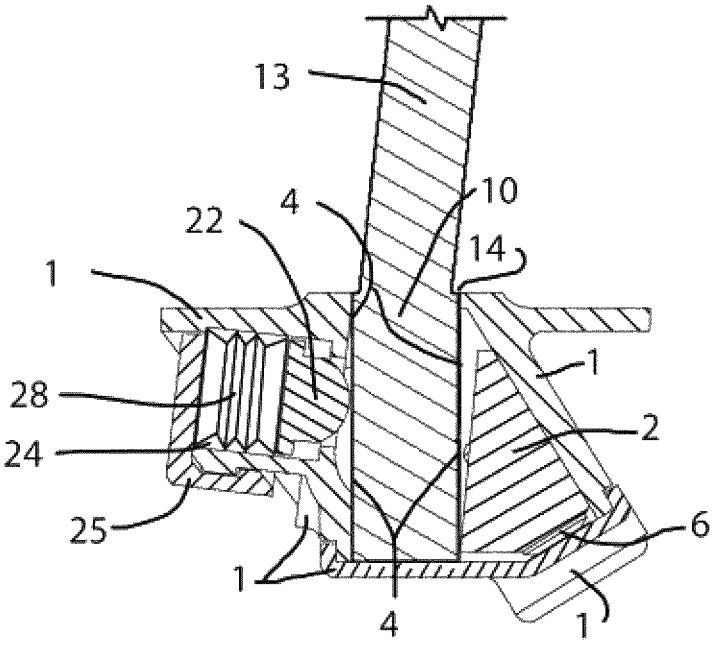
FIG. 23 is a cross-sectional view of one embodiment of the invention.

FIG. 23 is a cross-sectional view of one embodiment of the invention. Drawing 23 indicates the Futures type fin 13 and base 10 fully inserted into the channel 4 and showing the clip/latch/button pressed into the cavity 24 and compressing the 'spring' (indicated as 28) allowing the full insertion of the fin.

It will be realized that the above is illustrative of one or more examples of the invention, and that all such modifications and variations thereto as would be apparent to persons skilled in the art are deemed to fall within the broad scope and ambit of the invention as herein set forth.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A fin box assembly for a fin fixing system capable of accepting both a 1-tab fin and a 2-tab fin comprising a box, where the box comprises a channel, a cap, a spring embedded in a cavity, a wedge, a clip and a wedge adjustment screw, where the channel has a spring side and a wedge side, where the cap is connected to the box such that the cavity is formed, where the spring is retained in the cavity in an extended position, where the cavity has a cavity diameter, and there the spring has a spring diameter, and where the spring diameter is less than the cavity diameter, where the cavity has a cap end and a fin end, and where the cap end retains the spring, and where at the fin end, there are two box projections, one off a top box side and one off a bottom box side, where the two box projections create a spring stopper that retains the spring on the fin end, where the box has two forms, a 1-tab form and a 2-tab form, where the 1-tab form fits a 1-tab fin and the 2-tab form fits a 2-tab fin.

2. The fin box assembly of claim 1, where when the box is in the 2-tab form, the wedge is pushed toward the spring side of the channel by the wedge adjustment screw such that the wedge side of the channel is parallel to the spring side of the channel, such that when an 2-tab fin is pushed down into the channel, the clip is contacted by an engagement point on the 2-tab fin, and where the clip is moved toward the cap such that the spring is compressed, whereupon after the 2-tab fin is pushed further into the channel, a 2-tab fin cavity becomes aligned with the clip, whereupon the spring decompresses and pushes the clip into the 2-tab fin cavity, thereby removably securing the 2-tab fin in the box.

3. The fin box assembly of claim 1, where when the box is in the 1-tab form, the wedge is pulled back away from the spring side of the channel by the wedge adjustment screw such that when a 1-tab fin is pressed into the channel a 1-tab engagement point contacts the clip and compresses the spring, and as the 1-tab fin is further pushed into the channel, the spring remains compressed, thereby frictionally retaining the 1-tab fin in the channel.

4. The fin box assembly of claim 1, where when the box is in the 2-tab form, the wedge is pushed toward the spring side of the channel by the wedge adjustment screw such that the wedge side of the channel is parallel to the spring side of the channel, such that when an 2-tab fin is pushed down into the channel, the clip is contacted by an engagement point on the 2-tab fin, and where the clip is moved toward the cap such that the spring is compressed, whereupon after the 2-tab fin is pushed further into the channel, an 2-tab fin cavity becomes aligned with the clip, whereupon the spring decompresses and pushes the clip into the 2-tab fin cavity, thereby removably securing the 2-tab fin in the box, and, where when the box is in the 1-tab form, the wedge is pulled back away from the spring side of the channel by the wedge adjustment screw such that when a 1-tab fin is pressed into the channel a 1-tab engagement point contacts the clip and compresses the spring, and as the 1-tab fin is further pushed into the channel, the spring remains compressed, thereby frictionally retaining the 1-tab fin in the channel.

5. A fin box assembly for a fin fixing system providing a channel that can be altered to accept both a 1-tab fin and a 2-tab fin, additionally comprising a box, where the box comprises a channel, a cap, a spring embedded in a cavity, a wedge, a clip and a wedge adjustment screw, where the channel has a spring side and a wedge side.

6. The fin box assembly of claim 5, where the cap is connected to the box such that the cavity is formed, and where the spring is retained in the cavity in an extended position.

7. The fix box assembly of claim 6, where the cavity has a cavity diameter, and there the spring has a spring diameter, and where the spring diameter is less than the cavity diameter.

8. The fin box assembly of claim 7, where the cavity has a cap end and a fin end, and where the cap end retains the spring, and where at the fin end, there are two box projections, one off a top box side and one off a bottom box side, where the two box projections create a spring stopper that retains the spring on the fin end.

9. The fin box assembly of claim 8, where the box has two forms, a 2-tab form, and a 1-tab form, where the 2-tab form fits the 2-tab fin, and the 1-tab form fits the 1-tab fin.

10. The fin box assembly of claim 9, where when the box is in a 2-tab form, the wedge is pushed toward the spring side of the channel by the wedge adjustment screw such that the wedge side of the channel is parallel to the spring side of the channel, such that when a 2-tab fin is pushed down into the channel, the clip is contacted by an engagement point on the 2-tab fin, and where the clip is moved toward the cap such that the spring is compressed, whereupon after the 2-tab fin is pushed further into the channel, a 2-tab fin cavity becomes aligned with the clip, whereupon the spring decompresses and pushes the clip into the 2-tab fin cavity, thereby removably securing the 2-tab fin in the box.

11. The fin box assembly of claim 9, where when the box is in the 1-tab form, the wedge is pulled back away from the spring side of the channel by the wedge adjustment screw such that when a 1-tab fin is pressed into the channel a 1-tab engagement point contacts the clip and compresses the spring, and as the 1-tab fin is further pushed into the channel, the spring remains compressed, thereby frictionally retaining the 1-tab fin in the channel.

12. The fin box assembly of claim 9, where when the box is in the 2-tab form, the wedge is pushed toward the spring side of the channel by the wedge adjustment screw such that the wedge side of the channel is parallel to the spring side of the channel, such that when a 2-tab fin is pushed down into the channel, the clip is contacted by an engagement point on the 2-tab fin, and where the clip is moved toward the cap such that the spring is compressed, whereupon after the 2-tab fin is pushed further into the channel, a 2-tab fin cavity becomes aligned with the clip, whereupon the spring decompresses and pushes the clip into the 2-tab fin cavity, thereby removably securing the 2-tab fin in the box, and, where when the box is in the 1-tab form, the wedge is pulled back away from the spring side of the channel by the wedge adjustment screw such that when a 1-tab fin is pressed into the channel a 1-tab engagement point contacts the clip and compresses the spring, and as the 1-tab fin is further pushed into the channel, the spring remains compressed, thereby frictionally retaining the 1-tab fin in the channel.

13. The fin box assembly of claim 5, additionally comprising: a 1-tab fin channel, a 2-tab fin channel created by the encroachment of a wedge into the 1-tab channel moved by one or more wedge adjustment screws where the 2-tab fin can be inserted into the 2-tab channel, and the 1-tab fin can be inserted into the 1-tab fin channel when the wedge is retracted.

14. The fin box assembly of claim 5, where the 2-tab fin additionally comprises two wedge adjustment screws, where the two wedge adjustment screws fit into two wedge screw access holes and can be used to tighten or loosen the wedge when the 2-tab fin is inserted into the fin box assembly, and additionally comprising two grub screws where the two grub screws fit into two grub screw holes and can be used to tighten or loosen the 2-tab fin.

15. The fin box assembly of claim 6, where the two wedge adjustment screws can be tightened to force a 2-tab base into the indent for the 2-tab fin, thereby setting the 2-tab fin at an angle.

16. The fin box assembly of claim 5, where the 1-tab fin additionally comprises two wedge adjustment screws, where the two wedge adjustment screws fit into two wedge screw access holes and can be used to tighten or loosen the 1-tab fin when the 1-tab fin is inserted into the fin box assembly and additionally comprising two grub screws where the two grub screws fit into the two grub screw holes and can be used to tighten or loosen the 2-tab fin.

17. The fin box assembly of claim 16, as used for a canted 1-tab fin, where the two wedge adjustment screws fit into the two wedge screw access holes and can be used to tighten or loosen the 1-tab fin when the 1-tab fin is inserted into the fin box assembly, and where the two grub screws fit into the two grub screw holes and can be used to tighten or loosen a 2-tab fin.

18. The fin box assembly of claim 5, additionally comprising: a 1-tab fin channel and a 2-tab fin channel, where the 2-tab channel is created by the encroachment of a wedge into the 1-tab channel moved by wedge adjustment screws where a 2-tab fin can be inserted into the 2-tab channel.

19. The fin box assembly of claim 18, additionally comprising the 1-tab fin channel and the 2-tab fin channel, where the 1-tab fin can be inserted into the 1-tab fin channel when the wedge is retracted, where the two wedge adjustment screws fit into two wedge screw and can be used to tighten or loosen the wedge when the 2-tab fin is inserted into the fin box assembly, and additionally comprising the two grub screws where the two grub screws fit into the two grub screw holes and can be used to tighten or loosen the 2-tab fin, where the two wedge adjustment screws can be tightened to force the 2-tab base into the indent for 2-tab , thereby setting the 2-tab fin at a preferred angle, where the two wedge adjustment screws fit into the two wedge screw access holes and can be used to tighten or loosen the 1-tab fin when the 1-tab fin is inserted into the fin box assembly and additionally comprising two grub screws where the two grub screws fit into the two grub screw holes and can be used to tighten or loosen a 2-tab fin.

* * * * *